United States Patent [19]

Beisswanger

[11] Patent Number: 4,892,263

[45] Date of Patent: Jan. 9, 1990

[54] UNWINDING APPARATUS FOR A PAPER OR BOARD WEB

[75] Inventor: Rudolf Beisswanger, Steinheim, Fed. Rep. of Germany

[73] Assignee: J. M. Voith GmbH, Heidenheim, Fed. Rep. of Germany

[21] Appl. No.: 220,522

[22] Filed: Jul. 18, 1988

[30] Foreign Application Priority Data

Jul. 17, 1987 [DE] Fed. Rep. of Germany ..... 3723600

[51] Int. Cl.[4] ..... B65H 19/14

[52] U.S. Cl. ..... 242/58.3; 242/58.6; 156/508

[58] Field of Search ..... 242/56 R, 58.1–58.6; 156/502–508

[56] References Cited

U.S. PATENT DOCUMENTS

| | | | |
|---|---|---|---|
| 3,065,923 | 11/1962 | Karr | 242/58.3 |
| 3,195,827 | 7/1965 | Schowerer et al. | 242/58.3 |
| 3,327,959 | 6/1967 | Link et al. . | |
| 4,009,841 | 3/1977 | Matalia | 242/58.3 |
| 4,173,314 | 11/1979 | Curran et al. . | |
| 4,575,016 | 3/1986 | Pali . | |
| 4,681,274 | 7/1987 | Thievessen et al. | 242/58.3 |

FOREIGN PATENT DOCUMENTS 3440107 10/1984 Fed. Rep. of Germany .

*Primary Examiner*—John M. Jillions
*Assistant Examiner*—Steven M. duBois
*Attorney, Agent, or Firm*—Albert L. Jeffers; Richard L. Robinson

[57] ABSTRACT

An intermittently operating unwinding apparatus has a splicing unit with a cross member which is movable against and at right angles to the web expiring from a winding roll. With a separating device positionable against the cross member from the other side of the web, the web is separated by lifting the empty spool mounted in the unwinding apparatus out of its unwinding position. A new parent roll whose web beginning is provided with an application of adhesive is transported by means of a conveyor to the unwinding position and the web beginning positioned relative to the splicing unit. The splicing unit holding the separated web-end at the cross member is radially moveable against the new parent roll, where the web-end meets the beginning of the web and is attached by means of the adhesive. The web length required to lead the web-end to the new roll is made ready by a dancer roller.

10 Claims, 2 Drawing Sheets

UNWINDING APPARATUS FOR A PAPER OR BOARD WEB

BACKGROUND OF THE INVENTION

The invention relates to an unwinding apparatus for a paper or board web or the like for use with a succeeding rewind station, such as a two drum winder, a single drum winder, or the like.

Such an unwinding apparatus is known from U.S. Pat. No. 3,327,959. On it, an expiring winding roll (empty spool) is exchanged for a new, full roll (parent roll) while the web is being pulled off the winding roll at reduced speed. In the process the expiring roll is lifted out of the unwinding position and the new parent roll is conveyed out of its waiting position into the unwinding position. The web continuing to be unwound from the roll in the new position is led around a cross member designed as a guide roll, which extends close along the periphery of the new parent roll in the unwinding position. The new web- beginning on the parent roll is given an application of adhesive to attach the beginning of the web to the expiring web of the empty spool. For this purpose the peripheral speed of the parent roll must be matched to that of the unwinding web. Shortly before the web material on the spool has been fully unwound, the guide roll is swung against the periphery of the new, rotating parent roll in order to bring the end of the unwound web in contact with the splicing point of the parent roll. When the splice has been made, a separating device separates the expiring web, which carries the beginning of the web along onto the new parent roll. The empty spool is now lifted out of its position and deposited in a storage means out of which it can be taken with a hoist.

To be capable of performing such an exchange of the empty spool for the new parent roll, the known unwinding device involves a relatively expensive design: guideways and drive means must be prepared to convey the expiring roll out of the unwinding position. The succeeding new parent roll brought into the unwinding position is synchronized by means of a drive with the speed of the unwound web. Furthermore, a sophisticated machine control system is provided to perform the splicing operation. Nevertheless, with the known device, uncontrolled web doublings of different lengths occur during the splicing operation, which may lead to troubles with the subsequent processing of the web.

In the case of winding machines in which, for example, after a longitudinal slit of the unwound web, the web is wound up on two drums or single drums into rolls which are relatively large in diameter, it is necessary, on completion of these rolls, to stop the machine so that the rolls can be taken out of the machine. Completion of the rolls is arranged in such a way that during such a stop an empty spool can be exchanged for a new parent roll. The time advantage obtained with the aforementioned known unwinding apparatus decreases, however, quite considerably during the exchange of the empty spool for a parent roll.

A winding machine with an unwinding apparatus is known from German Patent Publication No. 34 40 107, with which, towards the end of the unwinding operation, a certain web length is stored in a web length storage means during machine shutdown and subsequently the web is separated. The stored web length is then wound up on a suction roll arranged parallel to the roll axis. The empty spool is thereafter lowered out of the unwinding apparatus with a conveyor, and when it has been transported away, a new parent roll is lifted into the unwinding position.

The suction roll is subsequently pressed against the periphery of the new parent roll and the web-end section on the suction roll unwound with simultaneous slow turning of the roll. Adhesive is then applied to the web-end at the periphery of the new parent roll, resulting in the end of the web being attached to the beginning of the new web, with inadmissibly long doublings of the web in the area of attachment being avoided by appropriate control of the suction roll and the winding roll drive. This control complicates the unwinding apparatus, since parent rolls with differing diameters have to be processed. In addition, drive means are required for rewinding the separated end portion of the web. Winding and unwinding of the web portion delays the changing operation of an empty spool for a new parent roll, as well as the consecutive separation of the web and depositing of the empty spool out of the unwinding apparatus. Furthermore, vertical transport of the rolls is disadvantageous, since a new winding roll can be supplied to the unwinding apparatus only after delivery of the empty spool from the handling equipment.

In addition, an unwinding apparatus designed for a "flying splice" is known from U.S. Pat. No. 4,173,314, with which a drive unit drives a parent roll provided with an application of adhesive around the periphery and an expiring winding roll with the same peripheral speed. An oscillating roll dipping into the drawn-off web is used to control the drive unit. In addition, a splicing unit is provided, which has no contact with the web in its neutral position. As the winding roll expires, a mark arranged on the end face at the parent roll, which stands in relation to the application of adhesive, triggers a swivelling movement of the splicing unit, so that the web is separated and the formed web-end is simultaneously attached to the parent roll.

On the other hand, U.S. Pat. No. 4,575,016 shows an unwinding apparatus on which the splicing operation takes place with the new winding roll at rest. Prior to this, however, the web is brought into a web length storage means in considerable length, so that the web can be withdrawn from the storage means during splicing and does not need to be interrupted. The web unwound from the virtually empty spool is firmly clamped to a splicing unit, separated and placed in a position in which the formed web-end is provided with an application of adhesive. Following this, the empty spool is removed and a new spool put in its place in a well-defined position. The splicing unit now presses the web-end against the beginning of the web at the periphery of the new spool. After attachment of the webs the clamp is removed and the splicing unit led away from the spool.

SUMMARY OF THE INVENTION

The invention is based on the task of simplifying an unwinding apparatus of the type mentioned at the beginning to achieve a splicing operation in a short time in intermittent operation. This task is solved by the features of the present invention.

The following advantages are achieved with the solution:

During the winding operation the splicing unit is out of contact with the web, which makes the unwinding of delicate webs safer.

The web length necessary for effectiveness of the splicing and separating apparatus as well as for leading in the web-end at the periphery of the new parent roll can be stored in interaction with a dancer roller in a simple way and again drawn off, which web length is also sufficient for new parent rolls with small diameters.

The separation of the expiring web from the empty spool is effected with secure holding of the web by clamping between the cross member of the splicing unit and the separating device. Transport of the empty spool out of the unwinding position, which is in any case necessary, is used for separation.

Since the beginning of the new web at the parent roll and the end of the web at the cross member of the splicing unit are in defined positions, when the end of the web is led in, a secure meeting of the two web sections is achieved. In this way web doublings following the splicing point are avoided. With the apparatus according to the invention, even with omission of the double unwind and the synchronizing unit required for two roll drives in the state of the art, a splicing operation can still be performed in a short time, since the end of the web is already formed on removal of the empty spool, and immediately afterwards can be attached to the new parent roll which has been led in.

Additional advantages achieved through further features of the invention are as follows:

A secure holding of the web-end at the splicing unit is achieved at low expenditure.

The relative position of the web-end is secured for the splicing operation.

On the one hand an intensive wrapping of the cross member is achieved on movement of the cross member against the web, and on the other, a secure striking of the web-end on the beginning of the web during the radial movement is achieved, even with differing parent roll diameters.

A functionally reliable separating device is disclosed with a low-wear separating element.

The web is securely held between the splicing unit and the separating device and can be subjected to the subsequent handling. In this way, influences originating from the top side or the bottom side of the empty spool due to the web expiration can be largely ruled out. As a function of the position of the lift-out device for the empty spool and its path of motion out of the unwinding position into the storage means, the separating device can be arranged on the corresponding web side so that on the tightening of the web which occurs while the empty spool is being lifted out, its separation at the perforation comb is securely achieved.

The positioning of the splice point at the parent roll is ensured so that the beginning of the web and the end of the web meet each other for the splicing operation.

BRIEF DESCRIPTION OF THE DRAWINGS

Embodiments of the invention are explained in greater detail below with the aid of the drawings.

DESCRIPTION OF THE PREFERRED EMBODIMENTS

Figure 1:
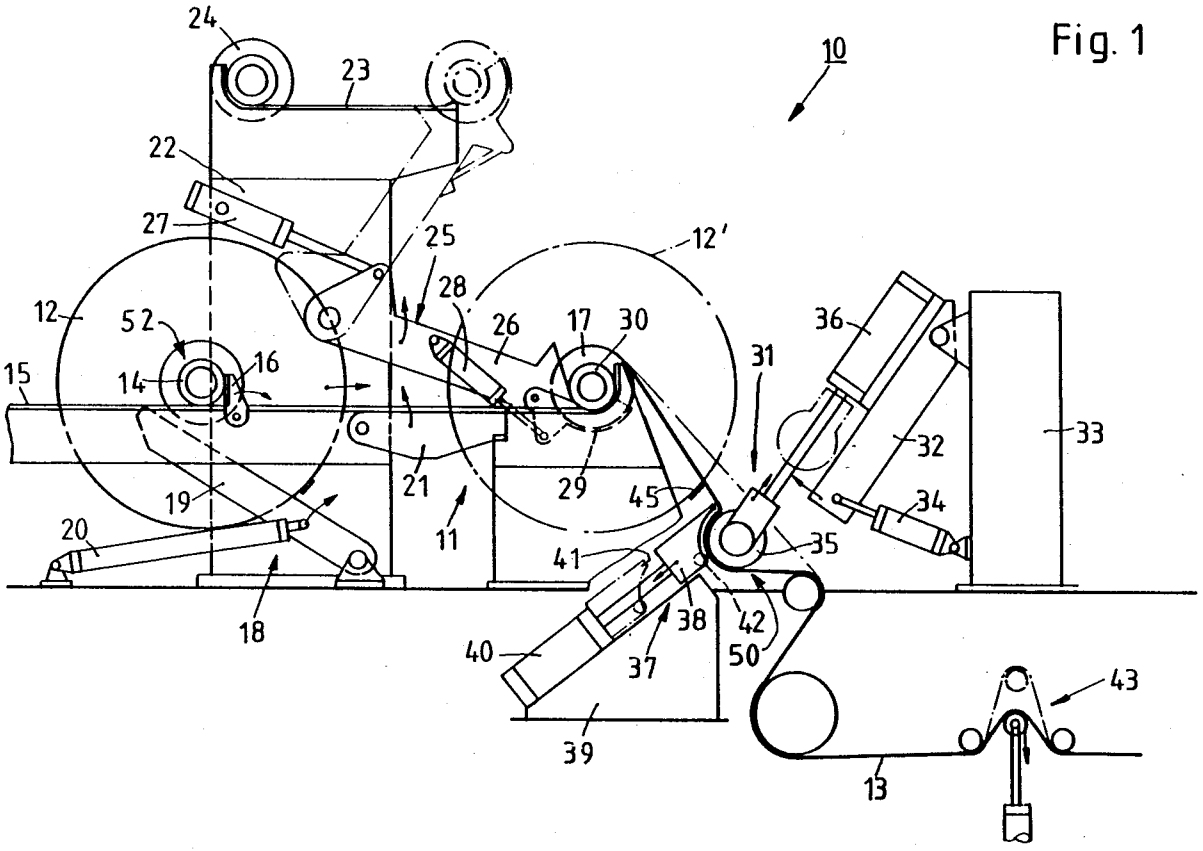
FIG. 1 shows as the first embodiment in schematic representation an unwinding apparatus for webs with an unwinding unit for a parent roll, with a device for separating the end of a web being unwound from an empty spool, with a unit for lifting this roll out of the unwinding position as well as with a splicing unit for connecting the end of the web to the beginning of the web of a new parent roll.

An unwinding apparatus 10 in FIG. 1 has an unwinding unit 11 in which parent rolls 12 coming out of a non-shown paper machine can be unwound. The web 13 exiting from such a roll runs in a working direction from left to right through a non-shown cutting mechanism and is wound up into finished rolls in a succeeding rewind station, such as a two drum winder, a single drum winder, and the like.

The parent roll 12 has a full-length roll axle 14, the ends of which project beyond the end faces of the roll. With these axle ends the parent roll 12 is rotatably mounted on guideways 15 of the unwinding unit which extend on both sides of the roll end faces in a horizontal plane. Guideways 15 lie parallel one behind the other in the drawing.

The parent roll 12 takes up its waiting position in the unwinding unit 11 shown with a solid line in the drawing. This position is predetermined by fold-away stops 16 at the guideways 15. A second, unwound roll (empty spool) 17 is also located in the unwinding unit 11. Further parent rolls coming from the paper machine can be laid by a hoist onto the guideways 15 in the area not shown, to the left of the roll 12.

For the transport of a parent roll 12 into the unwinding position a conveyor 18 is provided. This comprises swing arms 19 one behind the other in the drawing plane, which grip the ends of the roll axle 14 and are each movable by a thrust motor (piston-cylinder arrangement) 20.

To facilitate access by the operators of the unwinding apparatus 10 to the space between rolls 12 and 17 in waiting position and unwinding position, respectively, the guideways 15 are provided with swivelling bridges 21.

Arranged on both sides of the guideways 15 are machine frames 22 one behind the other (the front one is not shown in the drawing), which support a storage means 23 for empty spools 24. Mounted at the machine frames 22 there is also a unit 25 for lifting out empty spools located in the unwinding position. The lift-out unit comprises two arms 26 (lying congruently one behind the other in the drawing), which can be swivelled by thrust motors 27 between the unwinding position and the position indicated by chain lines. The arms 26 are provided at the ends with a dog 29 which can be swivelled by means of a thrust motor 28, with which the roll axle 30 of the empty spool 17 located in the unwinding position can be gripped at the ends.

To the right of the unwinding unit 11 the unwinding apparatus 10 has a unit 31 for splicing the unwound web 13 to the wound web of a new parent roll 12' located in the unwinding position.

The splicing unit 31 is swivellably mounted with a rocker 32 parallel to the longitudinal axis of the empty spool 17 at a machine frame 33. Drive means is provided by thrust motors 34 (one behind the other in the drawing) gripping the rocker 32 at one end and the machine frame 33 at the other end. The splicing unit 31 has a tubular cross member 35 running parallel to the roll axle 30. Cross member 35 can be moved transversely by thrust motors 36 arranged on the rocker 32 as drive means between a neutral position shown in chain lines in FIG. 1 and a working position shown in solid lines.

The unwinding apparatus 10 is also equipped with a separating device 37 to separate the web 13 being unwound from roll 17 at right angles to the direction of web travel. The separating device 37 arranged underneath the unwinding position of the unwinding unit 11 has a web-wide box-type cross member 38 which is movable in a direction toward the splicing unit 31 by thrust motors 40 mounted at a frame 39 and gripping the ends of cross member 38. The cross member 38 of the separating device 37 has on the web side a contour matched to cross member 35 of the splicing unit 31. The cross member 38 of the separating device 37 is equipped at its edge directed opposite to the direction of web travel with a perforation comb 41 for separating the web 13. In addition, the cross member is provided at its web exiting side edge with a flexible tube 42 running parallel to its longitudinal extension.

Finally, the unwinding apparatus 10 has a dancer roller 43 engaging the web 13 and located after the splicing unit 31 as well as the separating device 37 in the direction of web travel.

Figure 3:
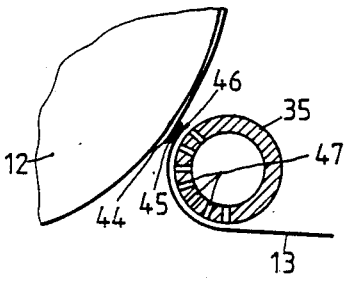
FIG. 3 shows as an enlarged detail for FIG. 2 the integration of the beginning of the web to the end of the web for top-side withdrawal of the web from the parent roll.
Figure 4:
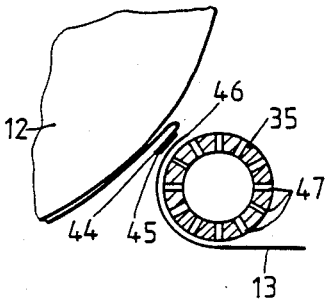
FIG. 4 shows as an enlarged detail for FIG. 2 the corresponding integration for bottom-side web withdrawal.

The mode of operation of the part of the unwinding apparatus 10 reproduced in the drawing is as follows:

During the unwinding process of a winding roll located in the unwinding position a new parent roll 12 is conveyed on the guideways 15 into its waiting position determined by the stops 16. The bridge 21 of the guideways 15 is swung into its vertical position so that an operator of the unwinding apparatus 10 can step into the space between the expiring roll 17 located in the unwinding position and the new winding roll 12 resting in the waiting position. The operator makes a web beginning portion 44 at the new parent roll 12 and provides this, with regard to whether the web is withdrawn from the roll on the top side or the bottom side, with an application of adhesive running parallel with the roll axis 14, e.g. a double-sided adhesive tape 45 (FIGS. 3 and 4). When the operator has stepped out of the unwinding unit 11, the bridges 21 are swung down so that they take up their position in line with the guideways 15.

With the completion of a set of finished rolls wound in the non-shown rewind station the unwinding apparatus 10 is brought to a stop. During the deceleration of the winding movement a certain length of web 13 is stored with the dancer roller 43 (chain lines). Just before the unwinding apparatus 10 comes to a standstill the cross member 35 of the splicing unit 31 is moved out of its neutral position, in which the cross member has no web contact, in a direction approximately at right angles to the unwound web towards the separating device 37. In so doing, the cross member 35 touches the web 13 expiring straight (chain line in FIG. 1) from the empty reel 17. With this mode of operation of the splicing unit 31 dipping into the running web, it is appropriate to design the cross member 35 as a roll (FIG. 4). If the splicing unit 31, on the other hand, is used only when the web has stopped running, the cross member 35 should be designed as a flexible tube (FIG. 3). In the course of its movement at right angles to the direction of web travel the splicing unit 31 pulls a certain length of the web 13 off the dancer roller 43, which wraps the cross member 35 along a part of its periphery in the working direction of the splicing unit 31.

With the unwinding apparatus 10 stationary, the separating device 37 is now put into operation by the machine control system and the cross member 38 moved out of its neutral position (drawn in chain lines in FIG. 1) with the thrust motors 40 in the direction towards the splicing unit 31. This movement is completed when the flexible tube 42 in the cross member 38 supports itself with web 33 as an intermediate layer against the cross member 35 of the splicing unit 31. In this position the cross member 38 of the separating device 37 has reinforced the wrap of the web 13 on the cross member 35 of the splicing unit 31. In addition, the perforation comb 41 of the separating device 37 on the side of the splicing unit 31 facing the rollers has penetrated the web 13. Following this, the machine control system puts the lift-out unit 25 into action at the empty spool 17 and lifts it out of its unwinding position. In the process the web 13 is tightened between the empty spool 17 and the splicing unit 31 and separated at the perforation comb 41. The lift-out unit 25 deposits the empty spool 17 in the storage means 23, where it can be fed with a non-shown hoist for further use in the paper machine.

Subsequently, the cross member 38 of the separating device 37 is returned to the neutral position by its thrust motors 40. In order that the end 46 of the web 13 formed by the separating process does not slip from the cross member 35 of the splicing unit 31, vacuum can be applied to this and holes provided around the periphery to hold the end of the web (FIGS. 3 and 4). In the embodiment of the cross member 35 as a non-rotatable flexible tube it is sufficient to arrange these holes 47 along the web-wrapped periphery of the flexible tube (FIG. 3). In the case of a cross member 35 designed as a roll, the holes 47 are provided around its entire periphery. A parking 50 associated with splicing unit 31 and coupled to cross-member 35 brake ensures, in the case of a cross member 35 designed as a roll, that the web-end 46 retains its position relative to the splicing unit 31 after the separating process.

The thrust motors 20 of the conveyor 18 are now put into operation so that the swing arms 19 acting on the roll axle 14 of the new parent roll 12 convey, with stops 16 disengaged, the new roll out of the waiting position into the unwinding position. In this position the roll axle 14 of the parent roll 12 is coupled with a brake generator 52. With the help of this, the parent roll 12 is positioned in the unwinding position so that the adhesive strip 45 at the beginning of the roll is opposite the web-end 46 at the cross member 35 of the splicing unit 31. Following this, the machine control systems puts into operation the thrust motor 34 of the splicing unit 31, which moves the cross member 35 in an approximately radial direction with respect to the roll axle 14 against the periphery of the new parent roll 12 located in the unwinding position. The web length required to perform this movement is gained by returning the dancer roller 43 in the direction of the arrow. The web-end held on the cross member 35 then touches the adhesive tape 45 at the beginning of the web 44. The already unwound web 13 is now securely attached to the web on the new parent roll 12.

With the splicing operation completed, the splicing unit 31 is brought into its position shown in FIG. 1 and the cross member 35 moved into its (in chain lines)

neutral position. The unwinding apparatus 10 is thus ready for operation again.

Figure 2:
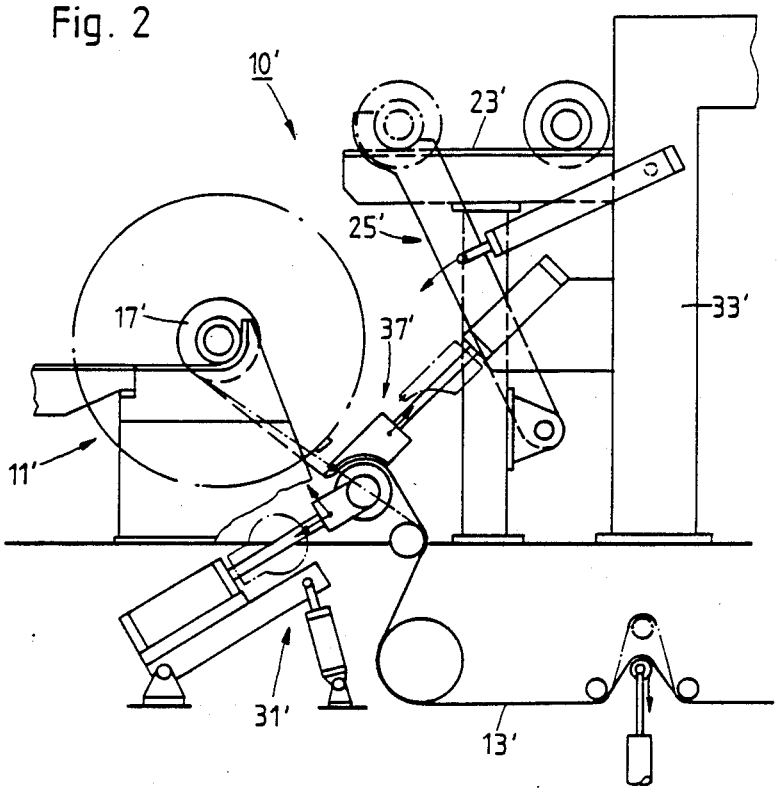
FIG. 2 shows as a second embodiment a variation of the first embodiment in respect of the reciprocal integration of the splicing unit and the separating device as well as of the lift-out device with storage means.

In the case of the embodiment according to FIG. 2, the reference symbols known from the previous embodiment are used for assemblies and components with identical functions, and namely with an additional apostrophe.

The embodiment of the unwinding apparatus 10' according to FIG. 2 deviating from FIG. 1 is attributable to the fact that the empty spool storage means 23' and the lift-out unit 25' are arranged at a machine frame 33' in the direction of web travel on the right beside the unwinding unit 11'.

To achieve a secure separation of the web 13' drawn off an empty spool 17' in the unwinding position, in contrast to the embodiment according to FIG. 1, the positions of the separating device 37' as well as of the splicing unit 31' have been reversed: the separating device 37' engages the top side of the web 13', whereas the splicing unit 31' engages the underside of the web. The mode of operation of the unwinding apparatus 10' is in agreement with the apparatus 10 according to FIG. 1.

What is claimed is:

1. An apparatus for unwinding a paper web wound as a parent roll on a roll axle for subsequent handling by a succeeding rewind station, said apparatus comprising:

an unwinding unit including guideway means for receiving the ends of the roll axle of the parent roll, the parent roll being movable between a waiting position and an unwinding position on said guideway means;

splicing means for splicing the web-end of an unwound web to the web-beginning of a parent roll located in the unwinding position, said splicing means including a cross member substantially parallel to the roll axle of the parent roll, the cross member being movable against the unwound web substantially perpendicularly to the direction of web travel from a position in which the cross member is out of contact with the web to a position in which the cross member is partially wrapped by the web-end of the unwound web, the cross member wrapped by the web-end being movable against the parent roll, the parent roll being provided at the periphery thereof with adhesive on the web-beginning, the parent roll during splicing being fixed in the unwinding position with the adhesive in the path of motion of the web-end wrapped on the cross member;

separating means for separating the web expiring from the parent roll substantially perpendicularly to the direction of web travel, said separating means being movable between a working position in which the web, when stationary, is clamped to the cross member of said splicing means by said separating means and a neutral position out of contact with the web to which said separating means is returned after separation of the web;

lifting means for lifting out of the unwinding position the roll axle of an expired parent roll whose expiring web has been separated by said separating means; and a dancer roller arranged after said splicing means in the direction of web travel, said dancer roller dipping into the unwound web expiring from the parent roll and emerging therefrom during splicing of the web.

2. The apparatus according to claim 1, in which the cross member is configured as a suction tube having holes at least in that portion wrapped by the web-end.

3. The apparatus according to claim 1, in which the cross member is configured as a roll which can be subjected to vacuum with holes on the periphery thereof.

4. The apparatus according to claim 3, in which the cross member is coupled with a parking brake.

5. The apparatus according to claim 1, in which said splicing means includes drive means for moving the cross member in a first direction at least approximately perpendicular to the unwound web and in a second direction at least approximately radial to the roll axle.

6. The apparatus according to claim 5, in which the cross member together with a thrust motor are mounted transversely shiftable on a rocker swivellable parallel with the roll axle.

7. The apparatus according to claim 1, in which said separating means includes a perforation comb positionable against the web ahead of the cross member of said splicing means in the direction of web travel.

8. The apparatus according to claim 1, in which said separating means includes a flexible tube pressing the web against the cross member of said splicing means.

9. The apparatus according to claim 1, in which the cross member of said splicing means is arranged on one side and said separating means is arranged on the other side of the web.

10. The apparatus according to claim 1, in which the parent roll is coupled in the unwinding position to a brake generator acting on the roll axle.

* * * * *